US005509689A

United States Patent [19]

Lin

[11] Patent Number: 5,509,689

[45] Date of Patent: Apr. 23, 1996

[54] HANDHOLD FOR A ROLLER SKATE

[76] Inventor: Tsang-Heng Lin, P.O. Box 1750, Taichung, Taiwan

[21] Appl. No.: 373,432

[22] Filed: Jan. 17, 1995

[51] Int. Cl.[6] ..... A63C 3/00; A63C 17/00

[52] U.S. Cl. ..... 280/811; 280/814; 16/115; 36/115; 36/132; 36/136

[58] Field of Search ..... 280/809, 811, 280/814, 11.22; 16/115, 124; 36/114, 132, 136, 138, 115

[56] References Cited

U.S. PATENT DOCUMENTS

| | | | |
|---|---|---|---|
| 384,155 | 6/1888 | Hathorn | 36/138 |
| 1,459,755 | 6/1923 | Speidel | 16/115 |
| 2,195,028 | 3/1940 | Finkelstein | 16/115 |
| 3,566,436 | 3/1971 | Marks et al. | 16/115 |
| 3,795,941 | 3/1974 | Szabo et al. | 16/115 |
| 4,134,480 | 1/1979 | Davis | 16/115 |
| 4,331,357 | 5/1982 | Contreras | 280/811 |
| 4,634,193 | 1/1987 | Liu | 16/115 |
| 5,005,868 | 4/1991 | Stein et al. | 280/814 |
| 5,276,983 | 1/1994 | Hatfield | 36/132 |
| 5,475,936 | 12/1995 | Cavasin | 280/11.22 |

*Primary Examiner*—Brian L. Johnson
*Attorney, Agent, or Firm*—Charles E. Baxley

[57] ABSTRACT

A roller skate is provided with a gripping apparatus comprising two buckles to which a holding strap is fastened in such a manner that the holding strap is attached in its entirety to the outer surface of the boot of the roller skate, and that the holding strap can be pulled out from a relaxed position to facilitate the carrying of the roller skate by hand.

1 Claim, 4 Drawing Sheets

HANDHOLD FOR A ROLLER SKATE

FIELD OF THE INVENTION

The present invention relates generally to a roller skate, and more particularly to a roller skate provided with a handhold to facilitate the holding of the roller skate.

BACKGROUND OF THE INVENTION

The conventional roller skate is relatively heavy and is not provided with a means to facilitate a person to take hold of it. As a result, the conventional roller skate can not be carried around easily and conventionally.

SUMMARY OF THE INVENTION

It is therefore the primary objective of the present invention to provide a roller skate with a gripping means comprising two buckles to which a holding strap is fastened in such a manner that the holding strap is attached to the outer surface of the boot of the roller skate, and that the holding strap can be pulled out to facilitate the carrying of the roller skate with a finger.

The foregoing objective, features and advantages of the present invention will be more readily understood upon a thoughtful deliberation of the following detailed description of the present invention in conjunction with the accompanying drawings.

DETAILED DESCRIPTION OF THE INVENTION

As shown in all drawings provided herewith, an embodiment of the present invention comprises a boot 1, two buckles 2 secured to the heel surface of the boot 1 and provided respectively with a hook 3, and a holding strap 4 of an elastic material.

Figure 1:
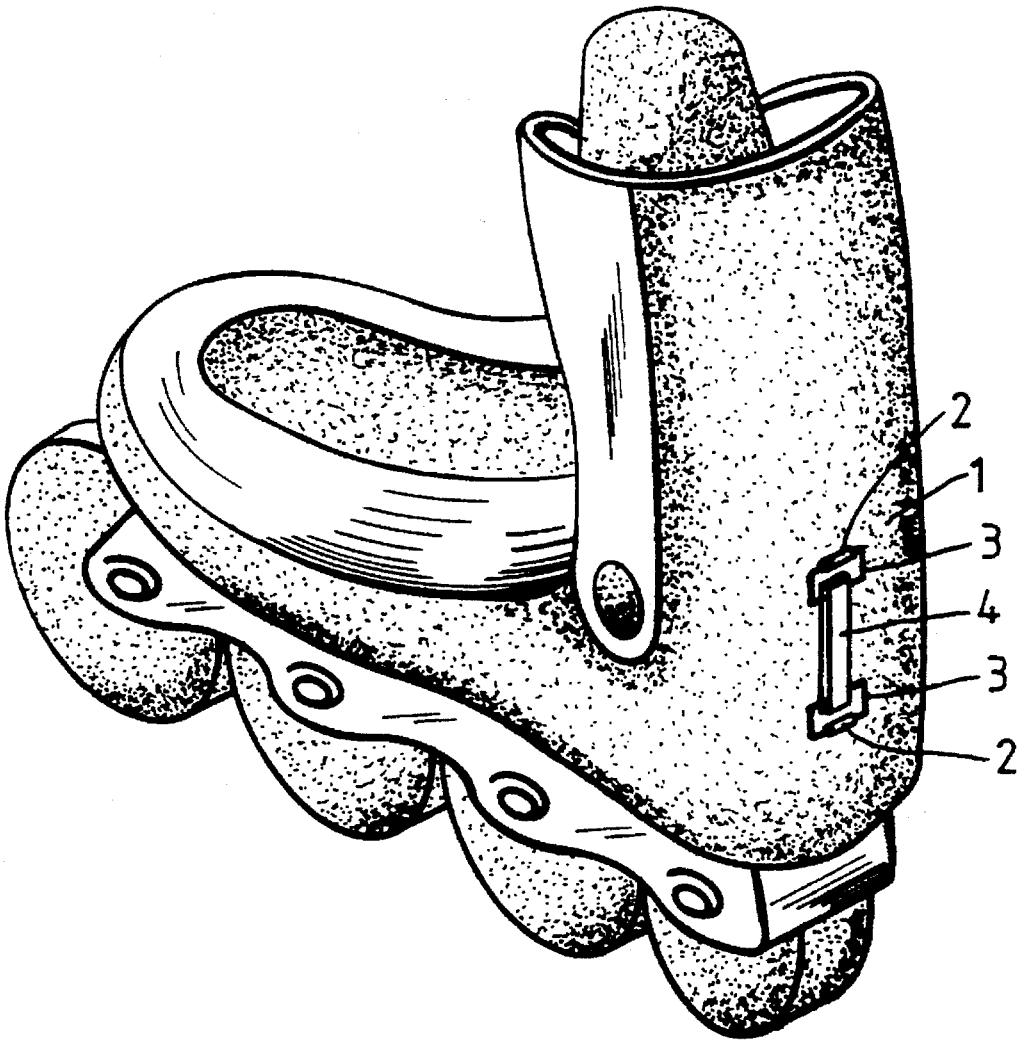
FIG.1 shows a perspective view of the present invention.
Figure 2:
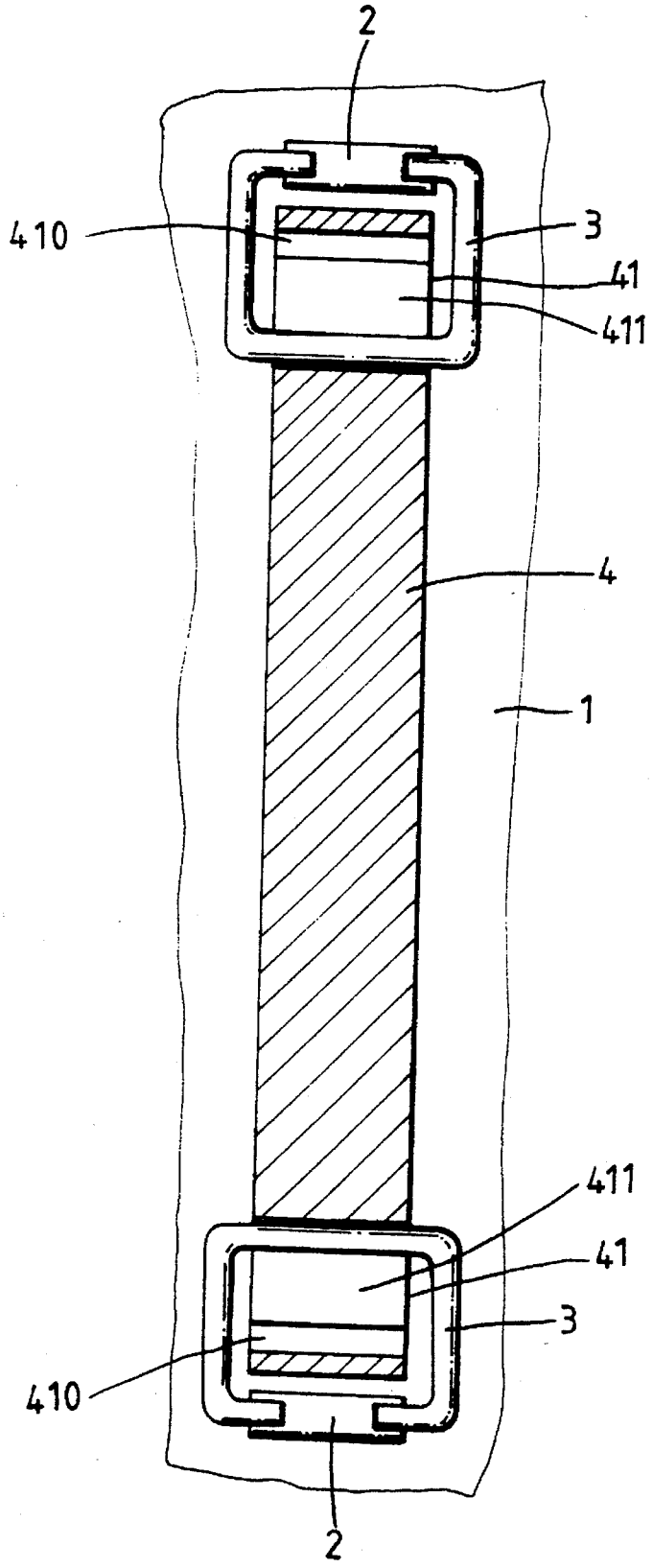
FIG. 2 shows a schematic view of the present invention.
Figure 3:
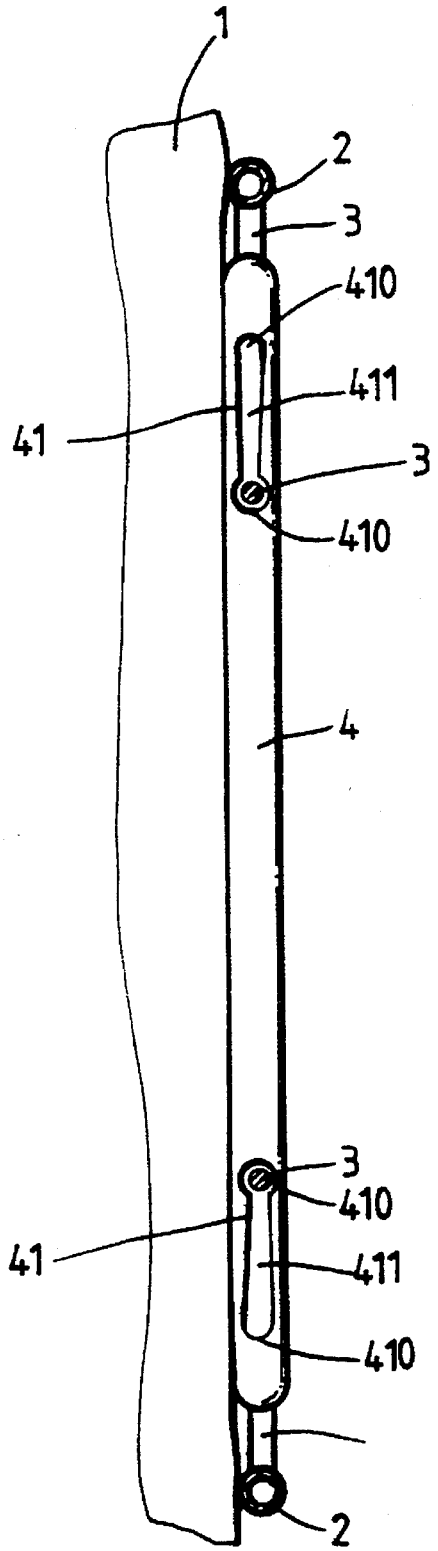
FIG. 3 shows a schematic view of the present invention when not in use.

As shown in FIGS. 2 and 3, the holding strap 4 is provided respectively at both ends thereof with a fastening hold 41 which is in turn provided at one end thereof with a round space 410, and a tapered space 411 adjacent to the round space 410. When the holding strap 4 is not in use to take hold of the boot 1, the holding strap 4 can be moved appropriately so as to cause one side of the hook 3 to be received in the round space 410, as shown in FIG. 2. In other words, one side of the hook 3 is located securely in the round space 410. As a result, the holding strap 4 is attached to the outer surface of the boot 1 when the holding strap 4 is not in use.

Figure 4:
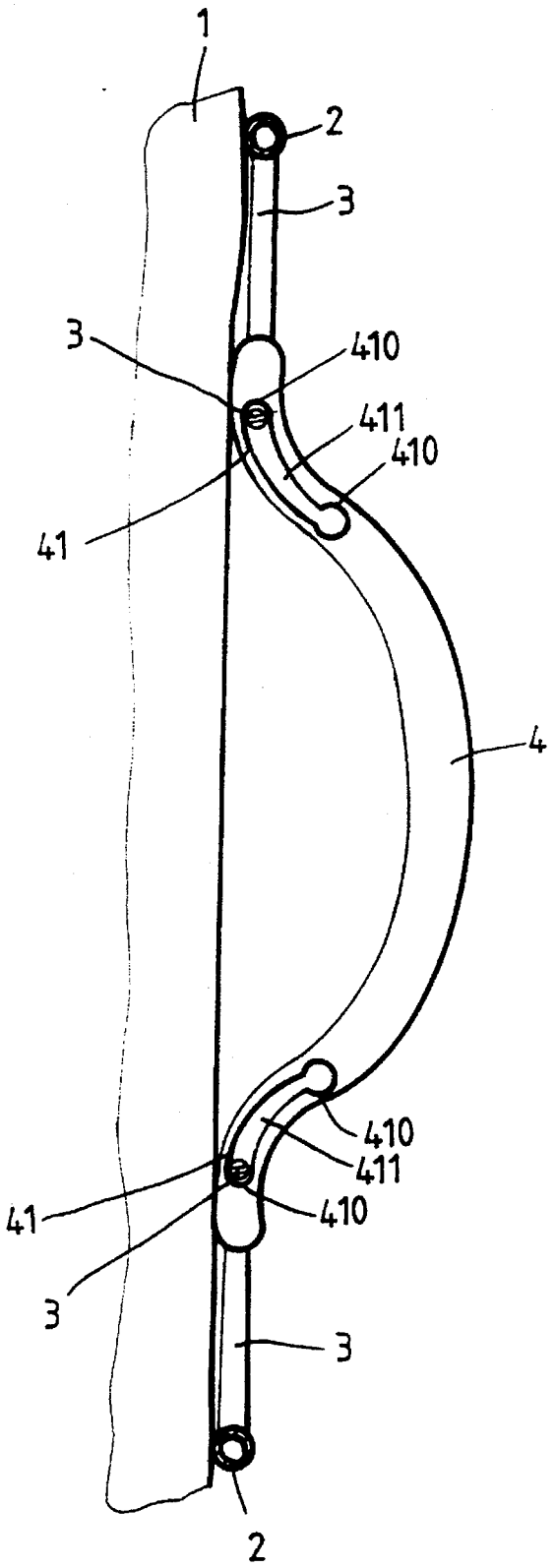
FIG.4 shows a schematic view of the present invention in use.

As shown in FIG.4, when the elastic holding strap 4 is pulled out to facilitate the carrying of the roller skate, the round space 410 of the holding strap 4 and the hook 3 are caused to move relatively, thereby resulting in the deformation of the junction between the round space 410 and the tapered space 411. As a result, one side of the hook 3, which is originally received in the round space 410, is caused to move easily into the tapered space 411. The distance between the two round spaces 410 of the fastening hole 41 is corresponding to the distance between the sides of the two hooks 3. As a result, when the holding strap 4 is pulled out, as shown in FIG. 4, the two hooks 3 are received respectively in the tapered spaces 411 so as to allow the holding strap 4 to relax. The roller skate can be therefore easily held even with one finger taking hold of the holding strap 4.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A roller skate comprising:

a boot including an outer surface, two buckles fastened at a predetermined interval to said outer surface of said boot, two hooks pivotally coupled to said buckles, and holding strap of elastic material, said holding strap including two ends each having a fastening hole formed therein for engaging with said hooks, said fastening holes of said holding strap each including a round space formed at opposite ends of said fastening hole and each fastening hole including a tapered space intermediate to said opposite round spaces for engaging with and for locating said hook, said hook being moved freely in and through said tapered space when said hook is received in one of said round spaces of said fastening hole.

* * * * *